United States Patent [19]

Genin

[11] 4,275,921

[45] Jun. 30, 1981

[54] FOLDING HOOD FOR CHAIR-LIFTS

[76] Inventor: Paul Genin, 90 rue d'Assas, 75006 Paris, France

[21] Appl. No.: 27,333

[22] Filed: Apr. 5, 1979

[30] Foreign Application Priority Data

Apr. 10, 1978 [FR] France ..... 78 10512

[51] Int. Cl.[3] ..... A49B 19/00

[52] U.S. Cl. ..... 297/184; 160/132; 135/4 R

[58] Field of Search ..... 297/184; 160/62, 132; 135/4 A, 4 R, 1 A, 1 R

[56] References Cited

U.S. PATENT DOCUMENTS

| | | | |
|---|---|---|---|
| 1,126,236 | 1/1915 | Lees | 160/132 X |
| 1,253,446 | 1/1918 | Wallace | 160/132 |
| 2,829,659 | 4/1958 | Megenity | 135/4 R X |
| 3,008,761 | 11/1961 | McIlvaine | 297/184 UX |
| 3,729,225 | 4/1973 | Savage | 297/184 |
| 3,747,974 | 7/1973 | Tauzin | 297/184 |
| 3,995,649 | 12/1976 | Robichaud | 135/4 A X |

FOREIGN PATENT DOCUMENTS

| | | | |
|---|---|---|---|
| 238055 | 1/1965 | Austria | 160/132 |

*Primary Examiner*—Roy D. Frazier
*Assistant Examiner*—Peter A. Aschenbrenner
*Attorney, Agent, or Firm*—William A. Drucker

[57] ABSTRACT

This folding hood for protecting the passengers of chair-lifts against weather conditions comprises a plurality of bows pivoted to one another, with the rearmost box pivoted to the chair, the front portion of the hood being transparent and the rear portion thereof being provided with a backlight, the hood when unfolded converting the chair into a substantially closed compartment leaving only a front, lower aperture for the passage of the passengers' legs, the arrangement being such that the conventional guard-rail equipping the chair cannot be raised unless the hood is opened.

3 Claims, 1 Drawing Figure

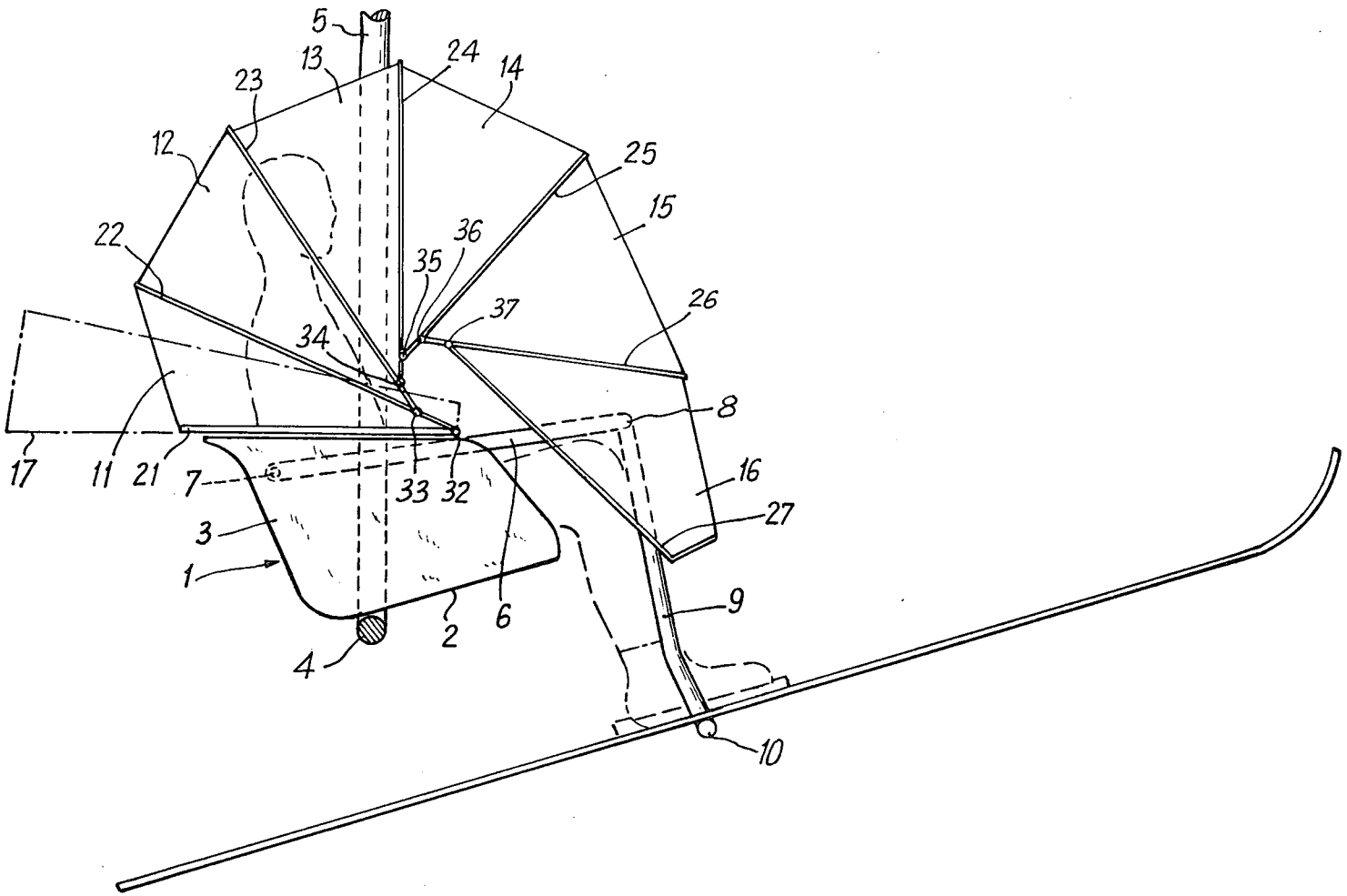
1
2
3
4
5
6
7
8
9
10
11
12
13
14
15
16
17
21
22
23
24
25
26
27
32
33
34
35
36
37

FOLDING HOOD FOR CHAIR-LIFTS

BACKGROUND OF THE INVENTION

It is known that ski-lifts constructed for the uphill transportation of skiers in ski resorts comprise inter alia chair-lifts in which the vehicles transporting the passengers, instead of bearing on the ground through wheels, are suspended from a pull and carrier rope supported by grooved rollers rotating on top of towers. Outside this property of "flying" over the generally uneven and snow-clad ground without touching it, the thus propelled chairs do not differ appreciably from conventional vehicles rolling on wheels and accomodating two or three passengers sitting side by side in the free air, without any protection against weather conditions.

SUMMARY OF THE INVENTION

The present invention is based on this last remark and relates to an adaptation, to chair-lifts, of a folding protection hood, the principle of which compares somewhat with the drop-heads equipping light-weight wheel-mounted vehicles such as drop-head coupes or like convertible automobiles.

Since the legs of the occupants of chair-lifts, which are usually shod with skis and ski-boots, extend well below the body of the chair or like vehicle comprising at the front only a lift-up or retractable guard-rail, the adaptation according to this invention is characterized essentially in that the hood, when unfolded towards the front of the vehicle, extends down to a level corresponding substantially to the passengers' mid-leg, while forming with the body of the vehicle a nearly completely closed "cockpit" or compartment providing at its bottom and front portion a single aperture permitting the free passage of the passengers legs. Moreover, since the hood must be lowered in front of the passengers in its unfolded position, the invention is further characterized in that the front portion of the hood comprises a transparent window substantially level with the field of vision of the passengers, when the hood is operative or in its unfolded position.

According to a complementary feature characterizing this invention, the hood or drop-head consisting of flexible wall elements disposed between and attached to bows pivoted sequentially to one another also comprises at the rear a transparent window or back-light disposed like the front window between two bows and level with the field of vision of the passengers.

The hinged hood bows are advantageously so designed as to fall by mere gravity into two stable positions, i.e. an unfolded position and a folded position, respectively, on either side of an intermediate "top dead center" position, so as to provide a useful over-center action.

Automatic or self-acting means, such as permanent magnets, may be provided for holding the bows in mutual abutting positions when the hood is folded and also for keeping the foremost bow in abutment against a suitable portion of the chair body in the unfolded or operative hood position, in order to prevent the hood from folding back untimely in case of gusty wind.

The complete hood can be secured to the top edge of the bucket-like chair body through its rearmost box by means of a quick-action fitting and removing device of known type, so that the complete hood assembly can be removed and refitted easily and rapidly when folded.

A complementary feature characterizing the invention lies in the fact that the free front edge of the hood safely prevents the guard-rail from being lifted untimely when the hood is not folded, said front edge also preventing the hood from being unfolded when the guard-rail is not lowered since the latter, having the usual foot-rest extension, would describe an arcuate path and strike the front free edge of the hood.

In order to afford a clearer understanding of this invention, an exemplary form of embodiment thereof is shown diagrammatically in the attached drawing of which the singe FIGURE is a side elevational view of a chair-lift equipped with the folding hood or drop-head according to this invention, shown in its operative or unfolded position.

DESCRIPTION OF THE PREFERRED EMBODIMENT

The chair-lift portion illustrated, which can accomodate two passengers sitting side by side (or even a single passenger) may have a bucket-like configuration as designated in general by the reference numeral 1, with a bottom 2 pivoted or not for facilitating the draining off of water or snow, constitutes internally a bench-type squab, and the rear portion 3 constitutes the backrest of the seat. This bucket-like chair may be rigid with a suspension frame or strap comprising a lower cross member 4 (shown in section) and side vertical members 5, this suspension frame being an integral part of a suspension system supported by a carrier and traction rope (not shown).

The bucket-like carrier chair 1 open at the front is provided in the known fashion with a pivotally-monted guard-rail, for example of frame-like configuration, having side arms 6 pivoted at their rear ends to the chair 1 by means of transverse pivot pins 7 and interconnected at their front ends by a front cross member 8. This front cross-member 8 carries for example at its center a rod 9 extending downwards in the operative position of the guard-rail and having its lower end rigidly secured to a transverse ski-rest 10.

The hood according to this invention comprises essentially flexible elements such as 11, 12, 13, 14, 15 and 16, each adapted to be folded or extended or stretched between a pair of successive bows denoted 21, 22, 23, 24, 25, 26 and 27; the rearmost bow 21 is secured to the top of chair 1 and the other bows are pivoted each to the preceding one by means of lateral pivot pins 32, 33, 34, 35, 36 and 37 respectively.

In the Figure, the outline of a passenger, shod with ski-boots and skis bearing on the ski-rest 10, is shown. It is clear that when arriving at the top station of the chair-lift, the passenger will firstly lift the hood towards the rear so as to fold same in the space shown in dash and dot lines 17, whereafter he will lift the guard-rail so that he can step out of the chair 1. When stepping in, the reverse sequence of operations are carried out, i.e. the passengers will be firstly lower the guard-rail and then unfild the hood forwardly.

The wall elements such as 12 and 15 located between two adjacent bows at the level of the passengers' field of vision consist of sheets made of suitable transparent flexible material.

It will be seen that in the operative hood position the foremost element 16 is lowered to a level corresponding substantially to the passengers mid-leg, thus providing a nearly completely closed compartment as already explained in the foregoing and illustrated in the drawing.

What I claim is:

1. A chair for chair-lifts adapted to transport passengers shod with ski-boots and skis, comprising:

a carrier body, a seat for passengers, rigid with said body and presenting an open front portion, a guard rail pivoted to said body and adapted to pivot between a backward rest position and a forward safety position in which said guard rail comes in front of the opened portion of the seat, a ski rest rigid with said guard rail, a plurality of bows comprising a first bow fixed to the seat, intermediary bows each pivoted at its respective ends only to the preceding bow at a point offset in relation to the respective ends of said preceding bow, and a last bow pivoted at its ends at respective points of the preceding bow off-set from the ends of the preceding bow, said last bow, in an operative position of the bows, extending down to mid-legs of the passengers and presenting a free edge abutting against the ski rest when the guard rail is in its safety position, and flexible wall elements disposed between said plurality of bows so as to constitute a folding hood, one of said flexible wall elements comprising a transparent element and being adapted, when the bows are in an extended operative position, to come in front of the passengers at the level of the field of vision thereof, so that when said bows are in their operative position, the folding hood constitutes with the chair body a nearly completely enclosed compartment providing at the front and bottom portion thereof only an aperture for a free passage of the passenger's legs shod with ski-boots and skis, while maintaining by the free edge of the last bow the guard rail in its safety position, and when said bows are in a folded backward inoperative position the folding hood is maintained in said folded position by the guard rail in its backward rest position.

2. Chair for chair-lifts according to claim 1, wherein a second one of said flexible wall elements which, in the operative position of the bows, is disposed backwards of the passengers and at the level of the field of vision thereof, is made of a transparent material.

3. Chair for chair-lifts according to claim 1, wherein said bows fall by gravity in two stable positions, namely their folded position and their operative position, on either side of an intermediate top dead center position.

* * * * *